US009962846B2

(12) United States Patent
Liu et al.

(10) Patent No.: US 9,962,846 B2
(45) Date of Patent: May 8, 2018

(54) HANDHELD ROTARY CUTTING BLADE

(71) Applicant: Qiuping Liu, Huizhou, Guangdong (CN)

(72) Inventors: Qiuping Liu, Guangdong (CN); Juan Jose Duran Lopez, Guangdong (CN)

(73) Assignee: Qiuping Lu, Huizhou, Guangdong (CN)

( * ) Notice: Subject to any disclaimer, the term of this patent is extended or adjusted under 35 U.S.C. 154(b) by 33 days.

(21) Appl. No.: 15/186,691

(22) Filed: Jun. 20, 2016

(65) Prior Publication Data

US 2017/0297214 A1 Oct. 19, 2017

(30) Foreign Application Priority Data

Apr. 15, 2016 (CN) ..... 2016 2 0323535 U

(51) Int. Cl.
*B26B 3/00* (2006.01)
*B26B 25/00* (2006.01)

(52) U.S. Cl.
CPC ..... *B26B 25/005* (2013.01)

(58) Field of Classification Search
CPC ..... B26B 25/005
USPC ..... 30/286, 307, 315, 316, 334, 339, 371; D7/694
See application file for complete search history.

(56) References Cited

U.S. PATENT DOCUMENTS

2004/0231475 A1* 11/2004 Cornfield ..... B26B 25/005 83/13
2011/0099818 A1* 5/2011 Moreland ..... B26B 25/005 30/319

* cited by examiner

*Primary Examiner* — Kenneth E. Peterson
*Assistant Examiner* — Samuel A Davies
(74) *Attorney, Agent, or Firm* — Rankin, Hill & Clark LLP

(57) ABSTRACT

A handheld rotary cutting blade includes a toroidal cutting blade and a handheld handle configured to package a section of the toroidal cutting blade; the toroidal cutting blade is arranged to be annular; another section of the toroidal cutting blade extends beyond the handheld handle; an outer side edge of the toroidal cutting blade is provided with a cutting edge; two rollers configured to respectively press against and support opposite inner sides of the toroidal cutting blade are respectively hinged at two opposite ends of the handheld handle; the two rollers are located at the same side relative to the center of the toroidal cutting blade, and the side is a side which keeps away from the middle of the handheld handle relative to the center; two rollers are respectively arranged at two ends of the handheld handle.

8 Claims, 9 Drawing Sheets

HANDHELD ROTARY CUTTING BLADE

FIELD OF THE INVENTION

The present application belongs to the field of knife tools, especially relates to a handheld rotary cutting blade.

BACKGROUND OF THE INVENTION

A handheld cutting blade is often used when cutting a pizza, a pancake, or other big flake objects. A current cutting blade is generally a long striped blade body of which one end is connected with a handle; the handle is gripped by a hand so as to operate the blade body to cut the flake object. However, during cutting, the blade can only cut a length of the blade body every time, and the cutting efficiency is low. Furthermore, during cutting, the handle located at one end the blade body is gripped, whereas the blade body at the other end is used to cut, and therefore the cutting requires large force.

SUMMARY OF THE INVENTION

The purpose of the invention is to provide a handheld rotary cutting blade, which aims to solve the problem that when a conventional blade is cutting a flake object, the cutting efficiency is low and the required force is large.

The invention is achieved as follows: a handheld rotary cutting blade which includes a toroidal cutting blade configured to cut and a handheld handle configured to package a section of the toroidal cutting blade; the toroidal cutting blade is arranged to be annular; the other section of the toroidal cutting blade extends beyond the handheld handle; an outer side edge of the toroidal cutting blade is provided with a cutting edge; two rollers configured to press against and support opposite inner sides of the toroidal cutting blade are respectively hinged at two opposite ends of the handheld handle; the two rollers are located at the same side relative to the center of the toroidal cutting blade, and the side corresponds to the side relative to the center which faces away from the middle of the handheld handle.

Furthermore, the handheld handle includes an upper handle which encircles an outer side edge of a section of the toroidal cutting blade, a lower handle which is fastened to the upper handle at the annular inner side of the toroidal cutting blade, and a locking mechanism configured for fixedly connecting two ends of the upper handle with two ends of the lower handle respectively. A first receiving slot is defined at an inner side of the upper handle; the lower handle defines a second receiving slot at a position corresponding to the first receiving slot; the first receiving slot and the second receiving slot cooperatively receive a section of the toroidal cutting blade.

Furthermore, the rollers are respectively mounted in two locking mechanisms.

Furthermore, two sides of each end of the upper handle are transversely provided with first clamp tracks; the lower handle is configured with second clamp tracks at the position corresponding to each clamp track; each of the locking mechanisms includes a locking body, one end of the locking body defines an opening configured or allowing the toroidal cutting blade to be inserted; the locking body further defines a clamp slot configured for cooperatively clamping the first clamp tracks and the corresponding second clamp tracks; the rollers are hinged in the locking body.

Furthermore, each of the locking body is equipped at the bottom with a receiving cavity configured for receiving the rollers; each roller is supported by hinge pins in the receiving cavity; each receiving cavity is provided therein with a slide slot configured for positioning the hinge pins, and the bottom of the locking body is covered by a bottom cap.

Furthermore, each end surface of the upper handle defines a slide hole; a side edge of each end surface of the upper handle defines an aperture communicated with the slide hole. The locking body defines a plughole at a position corresponding to the slide hole. The locking mechanism further includes a bolt slidingly mounted in the slide hole and a push handle configured for pushing the bolt into the plughole; the push handle is mounted at an end of the upper handle, and the push handle penetrates the aperture and is connected with the bolt.

Furthermore, the handheld rotary cutting blade further includes a brake plate configured to resist against the toroidal cutting blade so as to adjust the rotary speed of the toroidal cutting blade.

Furthermore, the brake plate resists against an annular inner side of the toroidal cutting blade; opposite inner sides of the lower handle defines a mounting hole communicated with the second receiving slot; one side of the brake plate penetrates the mounting hole through the second receiving slot and extends beyond the lower handle.

Furthermore, the lower handle defines a slot adapted to two ends of the lower handle and elastically bending inwards; the slot is arranged along a radial direction of the toroidal cutting blade.

Furthermore, the handheld rotary cutting blade further includes a soft plastic casing packaging one side of the lower handle that is away from the upper handle.

In the present invention, a section of the toroidal cutting blade is packaged by the handheld handle; another section of the toroidal cutting blade extends beyond the handheld handle; and two rollers are respectively arranged at two ends of the handheld handle. When the handheld handle is gripped by a hand, and the toroidal cutting blade is pressed downwards, the two rollers can respectively press against opposite inner sides of a lower section of the toroidal cutting blade and support the toroidal cutting blade, such that during the cutting process, the toroidal cutting blade can rotate and roll so as to better cut a flake object, which improves cutting efficiency, facilitates exerting strength, and reduces force required during cutting.

DETAILED DESCRIPTION OF THE PREFERRED EMBODIMENT

Figure 1:
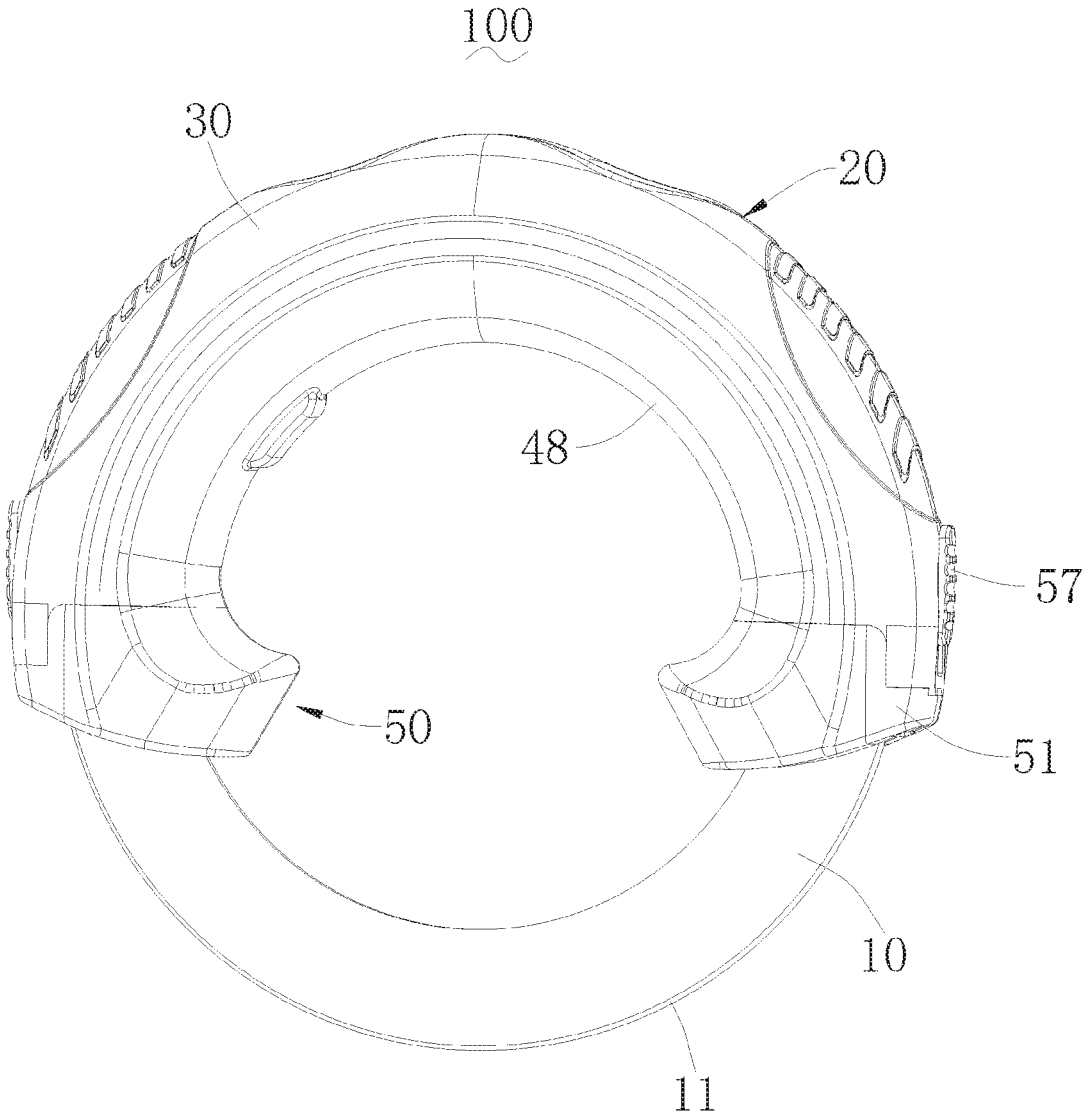
FIG. 1 is a perspective structural schematic view of a handheld rotary cutting blade provided by an embodiment of the present invention.

In order to make the purpose, technical solutions and advantages of the present invention more clear, the invention will be further described in detail with reference to the drawings and the embodiments. It is to be understood that the specific embodiments described herein are merely used for explaining the present invention but not intend to limit the present invention.

Please refer to FIGS. 1-9, a handheld rotary cutting blade 100 provided by an embodiment of the present invention includes a toroidal cutting blade 10 and a handheld handle 20. The toroidal cutting blade 10 is arranged to be annular, an outer side edge of the toroidal cutting blade 10 is provided with a cutting edge 11, the handheld handle 20 is mounted on the toroidal cutting blade 10, and the handheld handle 20 packages a section of the toroidal cutting blade 10 so as to facilitate gripping. Another section of the toroidal cutting blade 10 extends beyond the handheld handle 20 such that the cutting edge 11 on the section can be used to slide on a flake object and thereby slidingly cut the flake object, which improves cutting efficiency and reduces required force. Two rollers 60 are respectively hinged at two opposite ends of the handheld handle 20; the two rollers 60 are located at the same side relative to the center of the toroidal cutting blade 10, and the side is a side which keeps away from the middle of the handheld handle 20 relative to the center. When the toroidal cutting blade 10 is mounted on the handheld handle 20, the handheld handle 20 is grasped by a hand. During a cutting process, the toroidal cutting blade 10 is pressed downwards such that the two rollers 60 can respectively press against opposite inner sides of the toroidal cutting blade 10 and support the toroidal cutting blade 10 at the same time, thereby ensuring the stability of toroidal cutting blade 10. When the toroidal cutting blade 10 is moved for cutting, the toroidal cutting blade 10 can be rotated so as to cut a flake object in rotary.

The section of the toroidal cutting blade 10 is packaged by the handheld handle 20; another section of the toroidal cutting blade 10 extends beyond the handheld handle 20; and rollers 60 are respectively arranged at two ends of the handheld handle 20. When the handheld handle 20 is gripped by a hand, and the toroidal cutting blade 10 is pressed downwards, the two rollers 60 can respectively press against opposite inner sides of a lower section of the toroidal cutting blade 60 and support the toroidal cutting blade 10, such that during the cutting process, the toroidal cutting blade 10 can rotate and roll so as to better cut a flake object, which improves cutting efficiency, facilitates exerting strength, and reduces force required during cutting.

Figure 2:
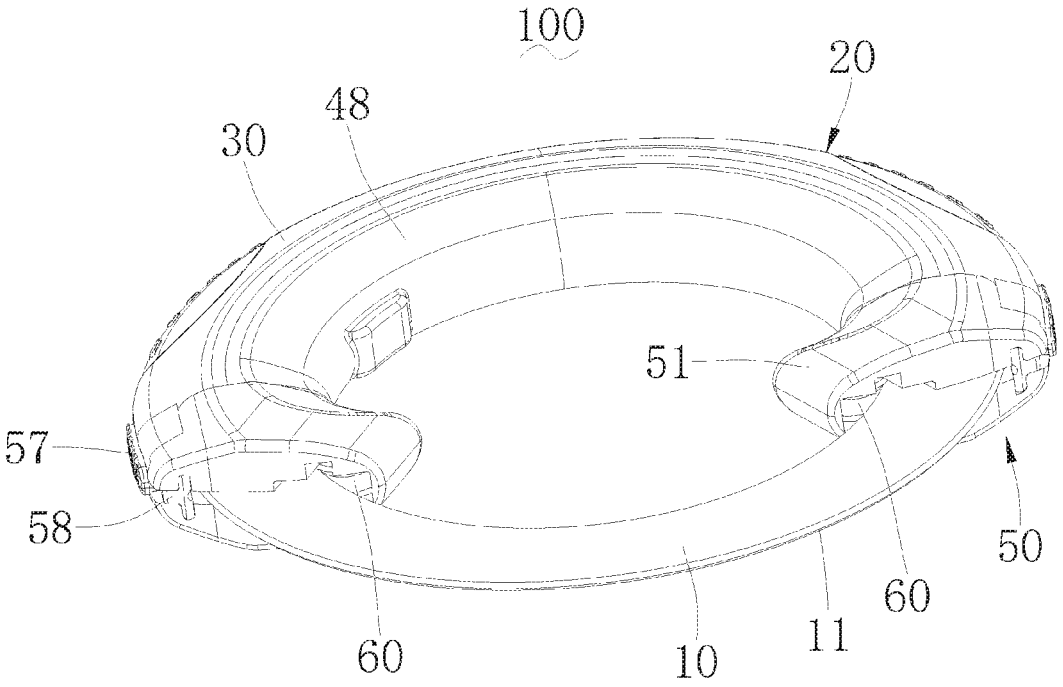
FIG. 2 is a perspective structural schematic view of the handheld rotary cutting blade shown in FIG. 1, viewed from another visual angle.
Figure 3:
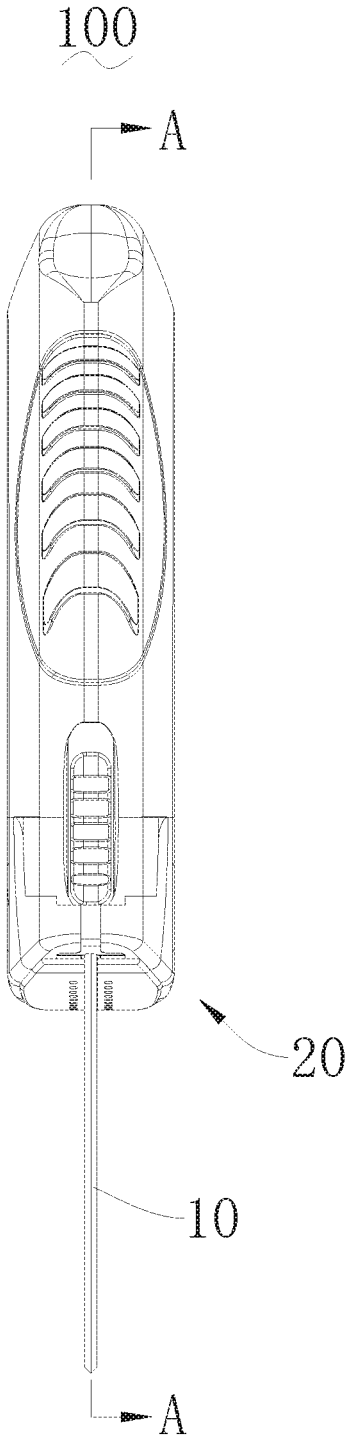
FIG. 3 is a side structural schematic view of the handheld rotary cutting blade shown in FIG. 1.
Figure 7:
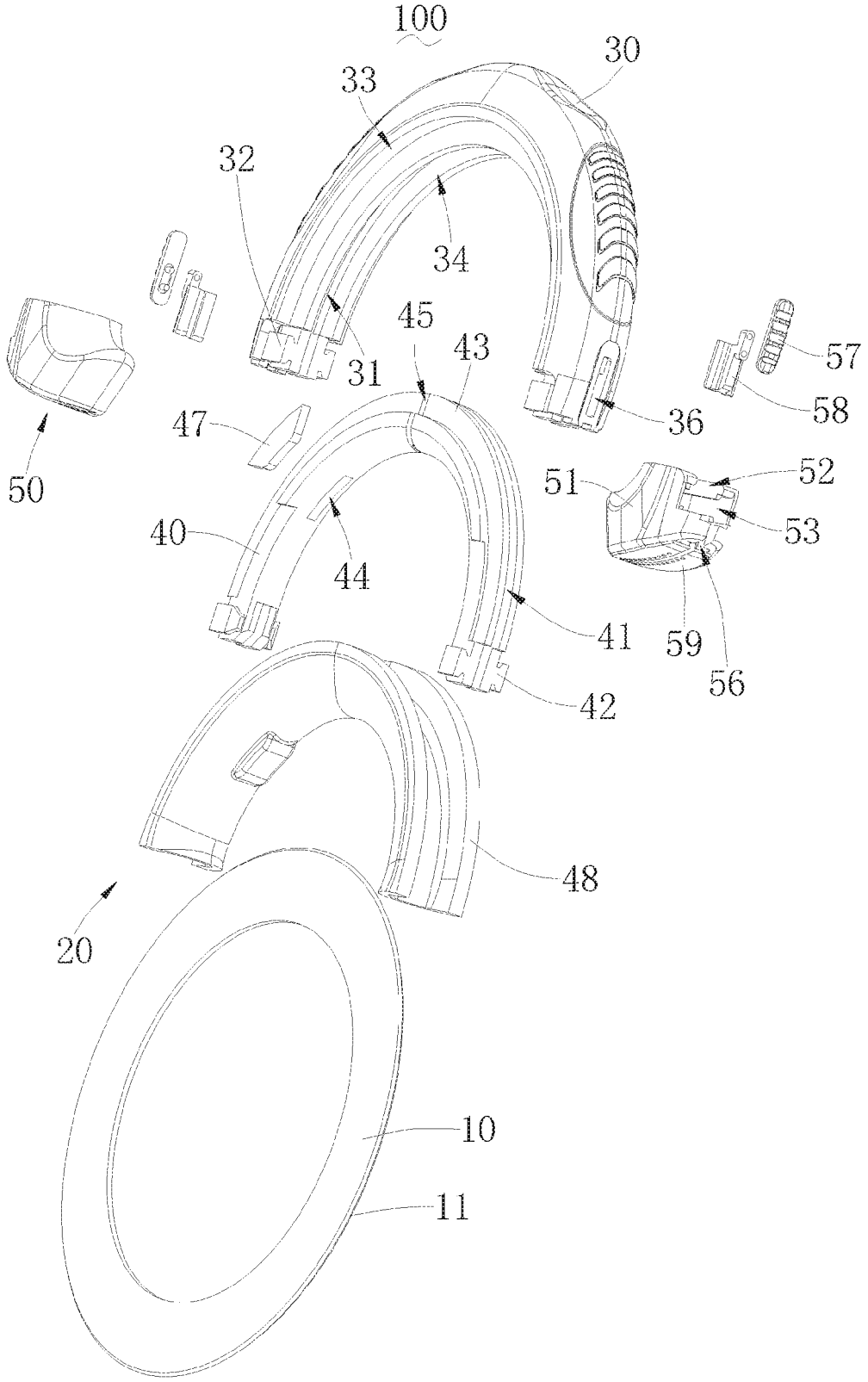
FIG. 7 is an exploded structural schematic view of the handheld rotary cutting blade shown in FIG. 1.
Figure 8:
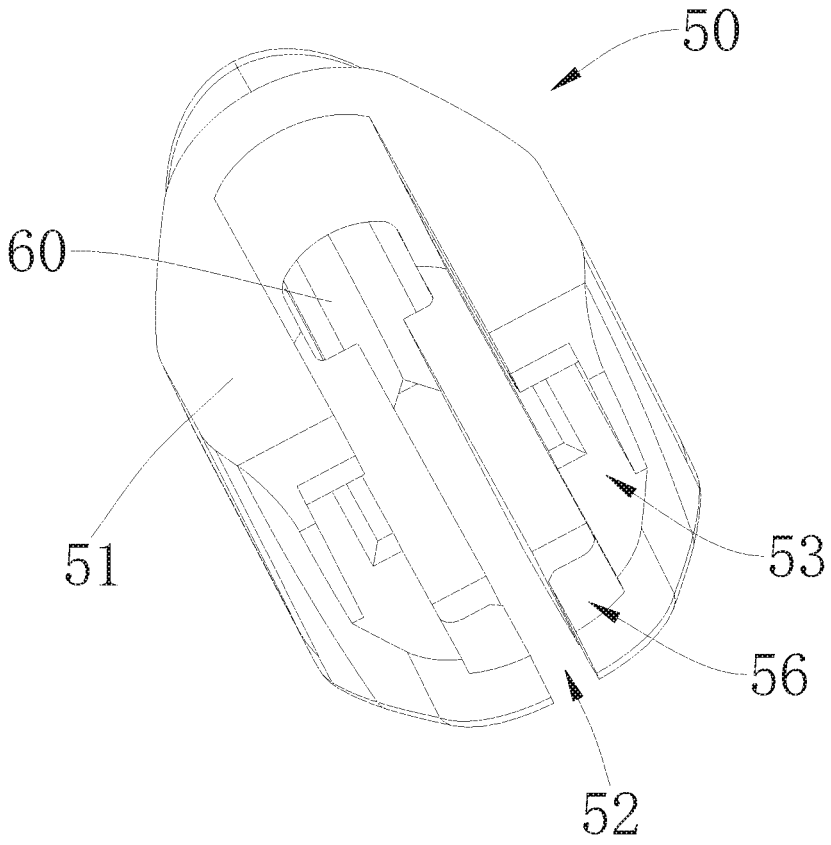
FIG. 8 is an enlarged structural schematic view of the locking mechanism shown in FIG. 7.
Figure 9:
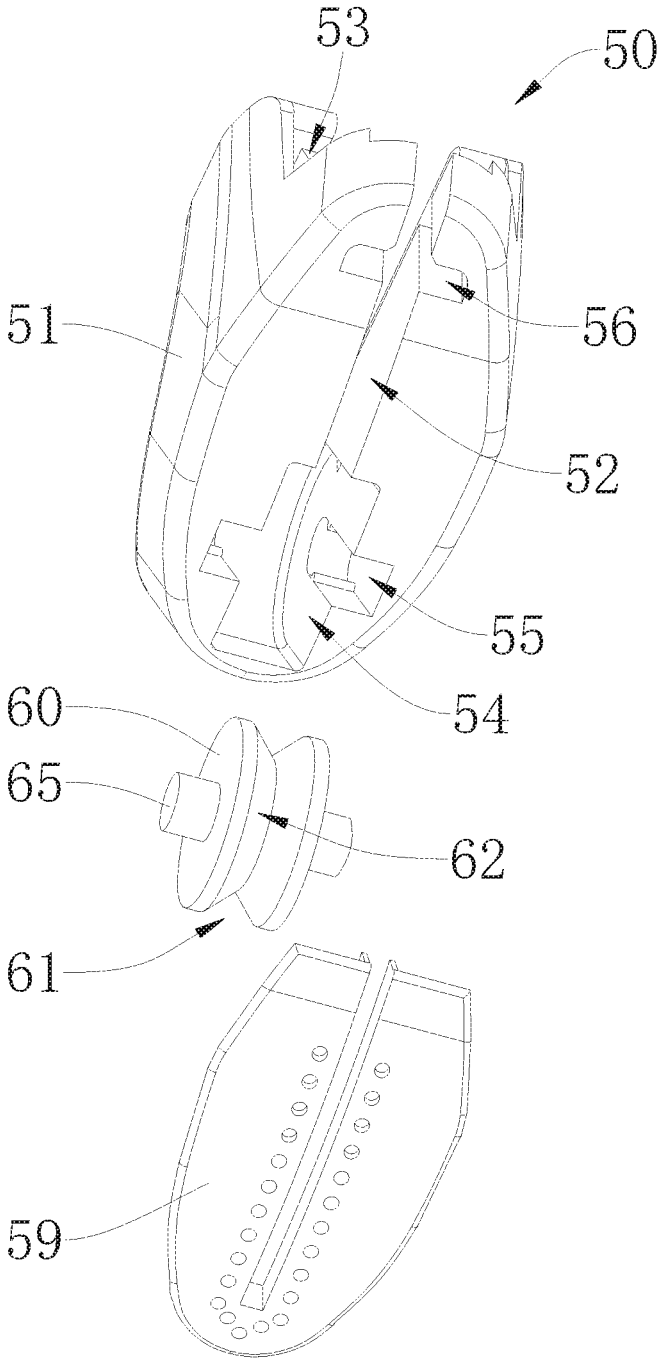
FIG. 9 is an exploded structural schematic view of the locking mechanism shown in FIG. 8.

Please refer to FIGS. 1, 2 and 7, the handheld handle 20 includes an upper handle 30, a lower handle 40, and a locking mechanism 50 configured for fixedly connecting two ends of the upper handle 30 with two ends of the lower handle 40 respectively. A relatively inner side of the upper handle 30 defines a first receiving slot 31. When an outer side edge of a certain section of the toroidal cutting blade 10 is inserted into the first receiving slot 31, the upper handle 30 can be sleeved in the outer side edge of the section of the toroidal cutting blade 10; the lower handle 40 is fastened with the upper handle 30 at an annular inner side of the toroidal cutting blade 10; a relatively inner side of the lower handle 40 defines a second receiving slot 41. The first receiving slot 31 and the second receiving slot 41 cooperatively receive a section of the toroidal cutting blade 10, such that the section of the toroidal cutting blade 10 is packaged by the handheld handle 20, which is convenient for gripping. During a mounting process, the lower handle 40 is arranged at the annular inner side of the toroidal cutting blade 10, and an inner side edge of a section of the toroidal cutting blade 10 extends into the second receiving slot 41; a relatively outer side of the section of the toroidal cutting blade 10 is encircled by the upper handle 30 such that the upper handle 30 is fastened with the lower handle 40, and then the locking mechanism 50 is utilized to fixedly connect two ends of the upper handle 30 with two ends of the lower handle 40.

In other embodiments, the rollers 60 can also be mounted on other locations of the handheld handle 20, so as to support the toroidal cutting blade 10 more steadily and ensure steady rotary of the toroidal cutting blade 10.

Furthermore, in the embodiment, two rollers 60 are respectively mounted in two locking mechanisms 50. By mounting the two rollers 60 in the two locking mechanisms 50 respectively, while disassembling the locking mechanisms 50, the two rollers 60 can be disassembled simultaneously, which is convenient for the lower handle 40 to be fetched from and mounted to the toroidal cutting blade 10. In other embodiments, the rollers 60 can also be mounted in the lower handle 40.

Please refer to FIGS. 5, 7, 8 and 9, two sides of each end of the upper handle 30 are transversely provided with first clamp tracks 32, and positions on the lower handle 40 corresponding to the first clamp tracks 32 are provided with second clamp tracks 42. Each locking mechanism 50 includes a locking body 51, one end of the locking body 51 defines an opening 52 configured for allowing the toroidal cutting blade 10 to be inserted; the locking body 51 further defines a clamp slot 53 configured for cooperatively clamping the first clamp tracks 32 and the corresponding second clamp tracks 42; the rollers 60 are hinged in the locking body 51. By arranging the first clamp tracks 32 at two sides of each end of the upper handle 30, after the upper handle 30 is mounted on the toroidal cutting blade 10, two first clamp tracks 32 of each end of the upper handle 30 are respectively located at two sides of the toroidal cutting blade 10. By arranging the second clamp tracks 42 at two sides of each end of the lower handle 40, after the lower handle 40 is mounted on the toroidal cutting blade 10, two second clamp tracks 42 of each end of the lower handle 40 are respectively located at two sides of the toroidal cutting blade 10. The locations of the second clamp tracks 42 correspond to the locations of the first clamp tracks 32; therefore, after the upper handle 30 and the lower handle 40 are fastened together and mounted on the toroidal cutting blade 10, the first clamp tracks 32 correspond to the second clamp tracks 42 in position. One end of the locking body 51 defines the opening 52, and the locking body 51 further defines the clamp slot 53; when the locking body 51 is transversely sheathed on the toroidal cutting blade 10, the toroidal cutting blade 10 can be arranged in the opening 52, and the first clamp tracks 32 and the second clamp tracks 42 can be inserted into the clamp slot 53, such that the first clamp tracks 32 and the second clamp tracks 42 are clamped by the locking body 51, and thus the upper handle 30 and the lower handle 40 are fixed on the toroidal cutting blade 10, and at the same time, the rollers 60 support opposite inner sides of the toroidal cutting blade 10. Specifically, a width of a side of each first clamp track 32 near the toroidal cutting blade 10 is relatively small, and a width of a side of each first clamp track 32 away from the toroidal cutting blade 10 is relatively large; a width of a side of each second clamp track 42 near the toroidal cutting blade 10 is relatively small, and a width of a side of each second clamp track 42 away from the toroidal cutting blade 10 is relatively large, such that the first clamp tracks 32 and the second clamp tracks 42 can be better clamped by the locking body 51.

Furthermore, a bottom of each locking body 51 defines a receiving cavity 54 configured for receiving the rollers 60; each roller 60 is supported by hinge pins 65 in the receiving cavity 54. Each receiving cavity 54 is provided therein with a slide slot 55 configured for locating the hinge pins 65, and the bottom of the locking body 51 is covered by a bottom cap 59. The bottom of each locking body 51 is provided with the receiving cavity 54 for conveniently mounting and receiving the rollers 60. The hinge pins 65 are utilized to support the rollers 60 such that the rollers 60 can be rotated in the locking body 51. Each receiving cavity 54 is provided therein with the slide slot 55 for conveniently positioning the hinge pins 65. The bottom of each locking body 51 is covered by the bottom cap 59, such that the rollers 60 are prevented from falling from the receiving cavity 54. When the rollers 60 are mounted, the rollers 60 can be mounted on the hinged pins 65, then the hinged pins 65 and the rollers 60 are slid into the slide slot 55 and the corresponding receiving cavity 54 through the bottom of the locking body 51; the bottom cap 59 is covered, and thus the rollers 60 are mounted in the locking body 51.

Furthermore, each roller 60 defines an annular slot. By defining the annular slot 61 in the roller 60, when the rollers 60 support the toroidal cutting blade 10, the opposite inner sides of the toroidal cutting blade 10 are located in the annular slot 61, such that the rollers 60 can better position the toroidal cutting blade 10 and ensure steady rotary of the toroidal cutting blade 10.

Furthermore, each annular slot 61 is provided with resisting surfaces 62 which respectively resist against two opposite side surfaces of the toroidal cutting blade 10. By arranging the resisting surfaces 62 on the annular slot 61 to resist against the two opposite side surfaces of the toroidal cutting blade 10, the rollers 60 can be prevented from abutting against the cutting edge 11 of the toroidal cutting blade 10, and thus the cutting edge 11 of the toroidal cutting blade 10 can be protected from damage, thereby prolonging a service life. Furthermore, in order to better position the toroidal cutting blade 10, the annular slot 61 of each roller 60 is set as a V shape.

Figure 4:
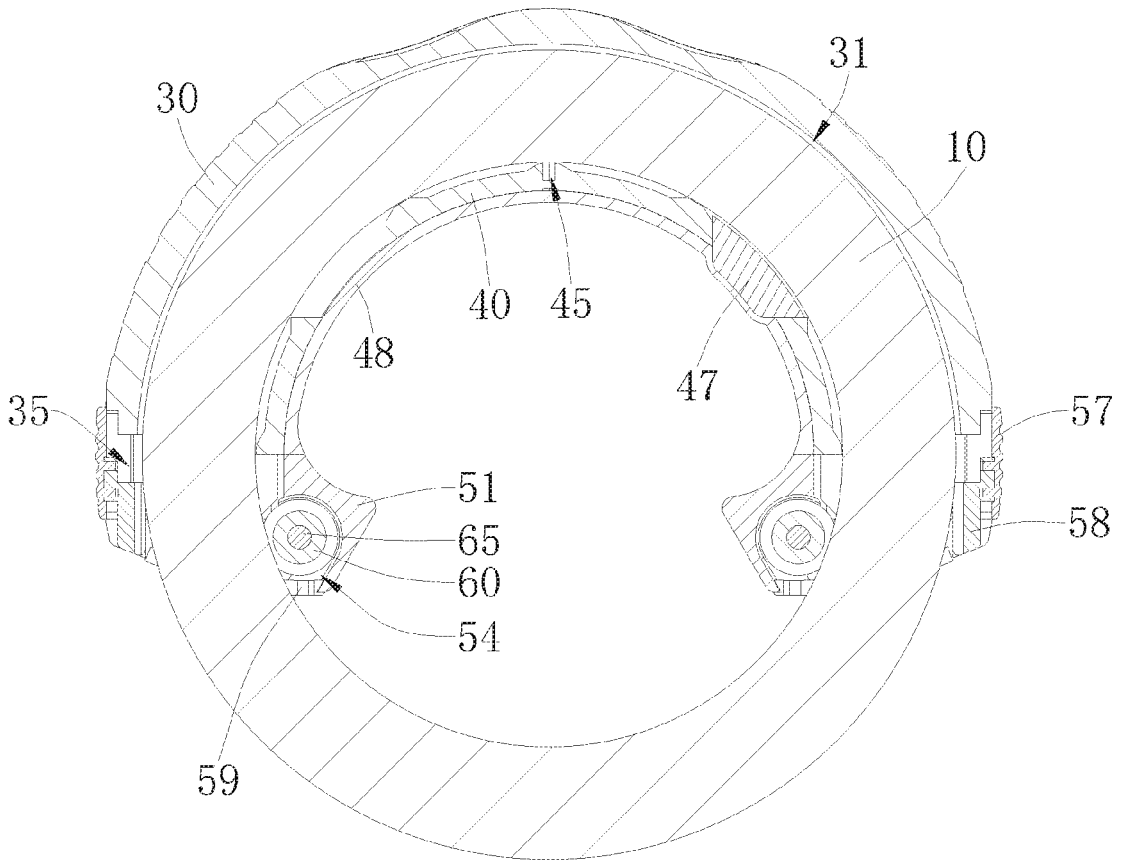
FIG. 4 is a cut-away view of a partial structure taken along the A-A line shown in FIG. 3.
Figure 5:
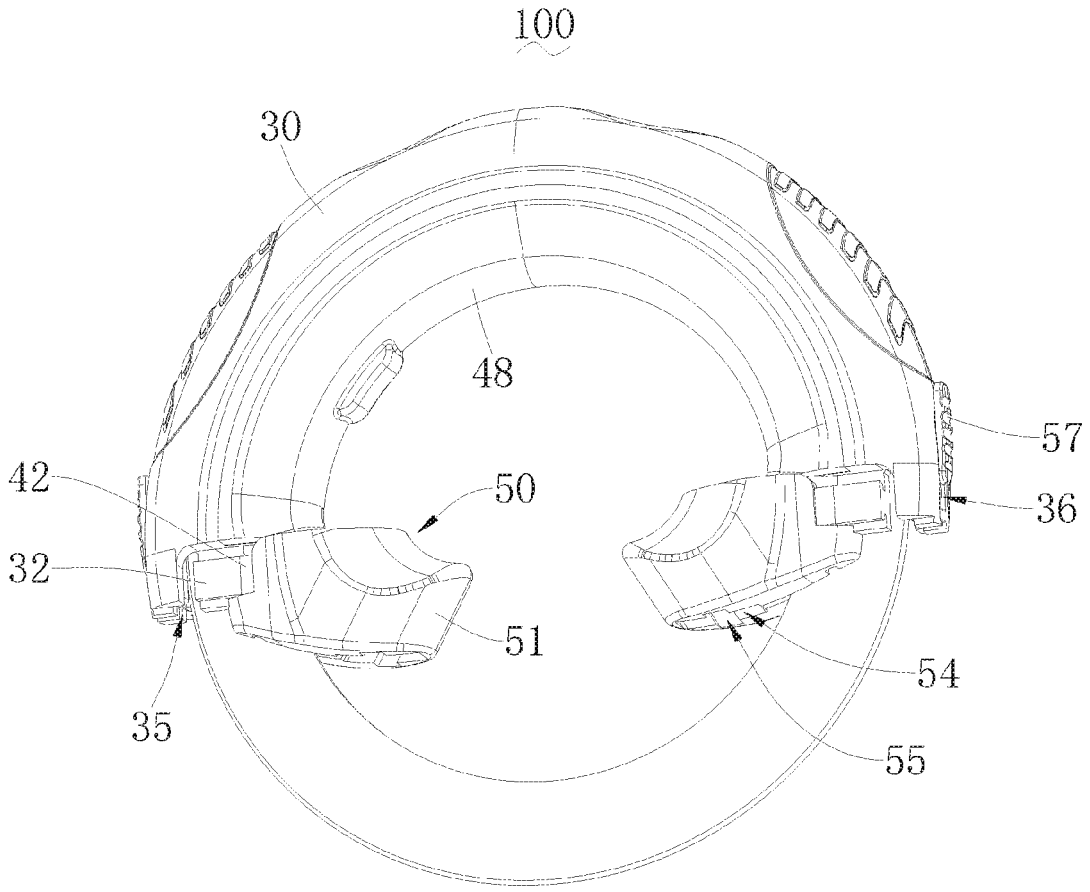
FIG. 5 is a structural schematic view of an unlocked locking mechanism of the handheld rotary cutting blade shown in FIG. 1.
Figure 6:
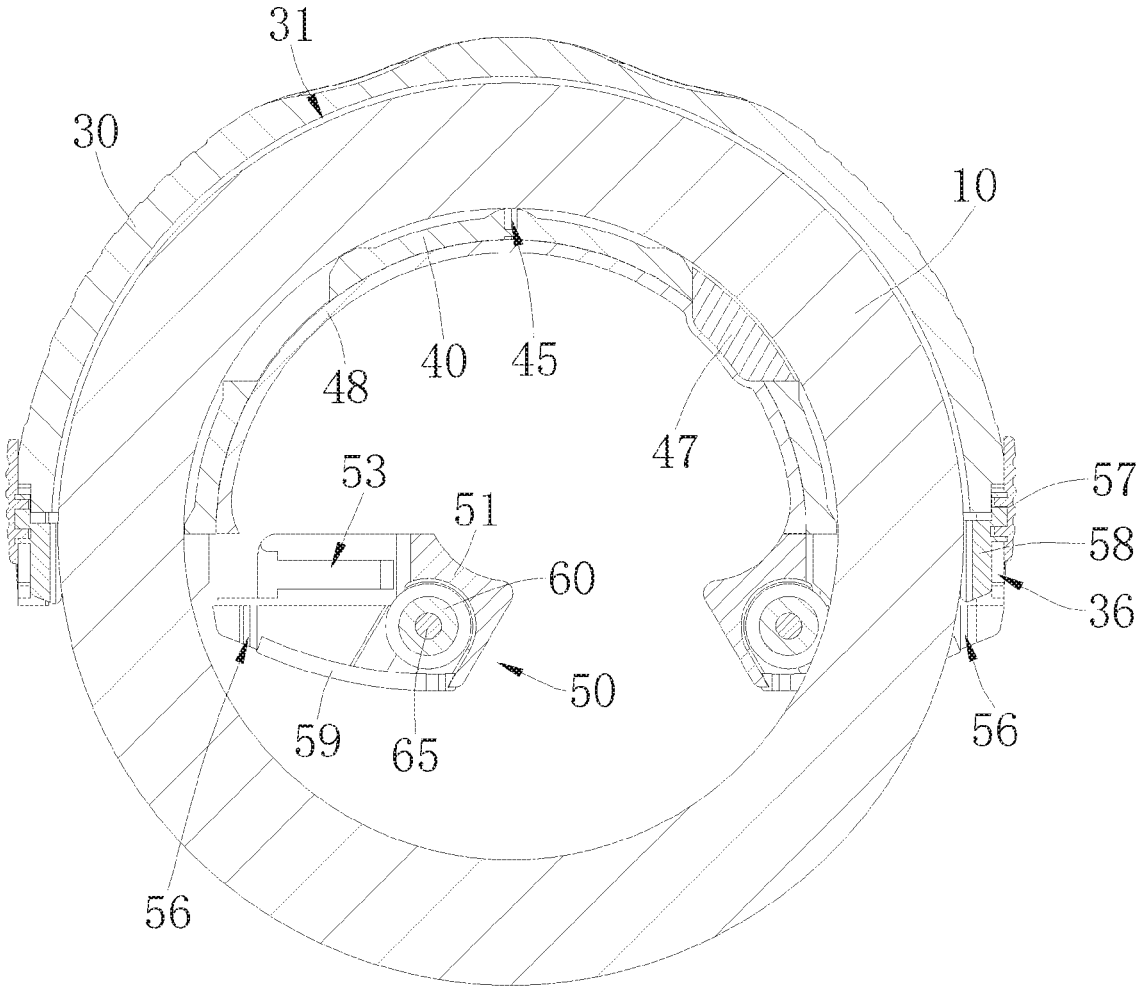
FIG. 6 is cut-away structural schematic view of the unlocked locking mechanism of the handheld rotary cutting blade shown in FIG. 1.

Furthermore, please refer to FIGS. 4 and 6, each end surface of the upper handle 30 defines a slide hole 35; a side edge of each end of the upper handle 30 defines an aperture 36 which is communicated with the slide hole 35. The locking body 51 defines a plughole 56 at a position corresponding to the slide hole 35. The locking mechanism 50 further includes a bolt 58 which is slidingly mounted in the slide hole 35 and a push handle 57 configured for pushing the bolt 58 into the plughole 56; the push handle 57 is mounted at an end of the upper handle 30, and the push handle 57 penetrates the aperture 36 and connects with the bolt 58. Each end surface of the upper handle 30 defines a slide hole 35, and the bolt 58 is mounted in the slide hole 35. The side edge of the upper handle 30 defines the aperture 36, the push handle 57 is mounted at the side edge of the upper handle 30, and the push handle 57 penetrates the aperture 36 and connects with the bolt 58; thus, by pushing the push handle 57, the bolt 58 can be driven to move in the slide hole 35. By defining the plughole 56 in the locking body 51, when the push handle 57 drives the bolt 58 to move towards the locking body 51, the bolt 58 can be inserted into the plughole 56. When the first clamp tracks 32 of the upper handle 30 and the second clamp tracks 42 of the lower handle 40 are inserted into the clamp slot 53 of the locking body 51, the locking body 51 can be locked at the upper handle 30 so as to prevent the locking body 51 from falling off, and thus the upper handle 30 is fixedly connected with the lower handle 40. During an unlocking process, the push handle 57 can be moved away from the locking body 51, the bolt 58 is driven to be separated from the locking body 51, and the locking body 51 can be fetched, such that the first clamp tracks 32 and the second clamp tracks 42 are separated from the clamp slot 53 of the locking body 51 so as to realize unlocking.

Furthermore, the handheld rotary cutting blade 100 further includes a brake plate 47; a relatively inner side of the lower handle 40 defines a mounting hole communicated with the second receiving slot 41; one side of the brake plate 47 penetrates the mounting hole 44 through the second receiving slot 41 and extends beyond the lower handle 40. Due to the arrangement of the brake plate 47, when the toroidal cutting blade 10 cuts slidingly, by pressing the brake plate 47, the brake plate 47 can resist against the annular inner side of the toroidal cutting blade 10 so as to control the rotary speed of the toroidal cutting blade 10, or the rotation of the toroidal cutting blade 10 can be stopped, such that the cutting force and the efficiency are better controlled and the using security is improved. In other embodiments, the brake plate 47 can be of other structures. For example, a pressing plate can be mounted in the second receiving slot 41, and a pushrod can be arranged on the pressing plate; the lower handle 40 defines an aperture at a position corresponding to the pushrod so that another end thereof extends beyond the lower handle 40. By pressing the pushrod, the pressing plate is pressed against a side surface of the toroidal cutting blade 10 so as to control the rotary speed of the toroidal cutting blade 10. Surely, the pressing plate can be mounted in the first receiving slot 31; the upper handle 30 defines an aperture at a position corresponding to the pushrod so that another end thereof extends beyond the upper handle 30; by pressing the pushrod, the pressing plate is pressed against a side surface of the toroidal cutting blade 10 so as to control the rotary speed of the toroidal cutting blade 10.

Furthermore, the lower handle 40 defines a slot 45 adapted to two ends of the lower handle 40 and elastically bending inwards; the slot 45 is arranged along a radial direction of the toroidal cutting blade 10. By providing the lower handle 40 with the slot 45, when detaching or mounting the lower handle 40, the two ends of the lower handle 40 can be bent towards each other, so as to better detach or mount the lower handle 40. In this embodiment, a middle position of the lower handle 40 defines the slot 45. In other embodiments, the slot 45 can be arranged at other positions of the lower handle 40.

Furthermore, the handheld rotary cutting blade 100 further includes a soft plastic casing 48 which packages one side of the lower handle 40 that is away from the upper handle 30. By arranging the soft plastic casing 48, the handheld handle 20 can be held more steady and comfortable.

Furthermore, two opposite sides of the lower handle 40 are respectively provided with protruded locating plates 43, and the upper handle 30 defines locating slots 34 configured for receiving the locating plate 43; the locating slots 34 are communicated with the first receiving slot 31. By arranging the locating slots 34 at the upper handle 30 and arranging the locating plates 43 at the lower handle 40, when the lower handle 40 is fastened with the upper handle 30, the two locating plates 43 extend into corresponding locating slots 34, such that the upper handle 30 can be better fastened with the lower handle 40. Furthermore, two opposite sides of the upper handle 30 define receiving openings 33, when the soft plastic casing 48 is arranged, two opposite sides of the soft plastic casing 48 extend into the receiving openings 33 of the upper handle 30, such that the soft plastic casing 48 packages the joint between the upper handle 30 and the lower handle 40.

The above contents are only preferred embodiments of the present invention, but not intended to limit the present invention; and any modification, replacement and improvement made within the spirit and principle of the present invention should be included within the protection scope of the present invention.

What is claimed is:

1. A handheld rotary cutting blade, wherein the handheld rotary cutting blade comprises a toroidal cutting blade configured to cut and a handheld handle configured to package a section of the toroidal cutting blade; the toroidal cutting blade is annular shaped; another section of the toroidal cutting blade extends beyond the handheld handle; an outer side edge of the toroidal cutting blade is configured with a cutting edge; two rollers configured to respectively press against and support opposite inner sides of the toroidal cutting blade are respectively hinged at two opposite ends of the handheld handle; the two rollers are located at a same side relative to a center of the toroidal cutting blade, and the side corresponds to a side relative to the center which faces away from the middle of the handheld handle;

wherein the handheld handle includes an upper handle which encircles an outer side edge of a section of the toroidal cutting blade, a lower handle which is fastened to the upper handle at an annular inner side of the toroidal cutting blade and two locking mechanisms for fixedly connecting two ends of the upper handle with two ends of the lower handle respectively, a first receiving slot is arranged at an inner side of the upper handle, the lower handle is configured with a second receiving slot at a position corresponding to the first receiving slot, the first receiving slot and the second receiving slot jointly receive a section of the toroidal cutting blade; and wherein the rollers are separately installed in the two locking mechanisms.

2. The handheld rotary cutting blade of claim 1, wherein two sides of each end of the upper handle are configured with first clamp tracks traversly; the lower handle is configured with second clamp tracks at a position corresponding to each clamp track; each of the locking mechanisms includes a locking body, of which one end is equipped with an opening for the toroidal cutting blade to be inserted into; the locking body is further equipped with a clamp slot for jointly clamping the first clamp tracks and a corresponding second clamp tracks; the rollers are hinged in the locking body.

3. The handheld rotary cutting blade of claim 2, wherein each of the locking body is equipped at the bottom with a receiving cavity for receiving the rollers; each roller is supported by hinge pins in the receiving cavity; each receiving cavity is equipped with a slide slot for locating the hinge pins, and the locking body is equipped at the bottom with a bottom cap.

4. The handheld rotary cutting blade of claim 2, wherein each end surface of the upper handle is equipped with a slide hole; a side edge of each end surface of the upper handle is equipped with a aperture which is intercommunicated with the slide hole; the locking body is equipped with a plughole at a position corresponding to the slide hole; the locking mechanism further includes a bolt 58 which is slidingly installed in the slide hole, and a push handle for pushing the bolt into the plughole; the push handle is install at an end of the upper handle, and the push handle penetrates the aperture and connects with the bolt.

5. The handheld rotary cutting blade of claim 1, wherein the handheld rotary cutting blade further includes a brake plate configured to resist against the toroidal cutting blade so as to control the rotary speed of the toroidal cutting blade.

6. The handheld rotary cutting blade of claim 5, wherein the brake plate resists against an annular inner side of the toroidal cutting blade; two opposite inner sides of the lower handle are equipped with an installing hole intercommunicated with the second receiving slot; one side of the brake plate penetrates the installing hole through the second receiving slot and extends beyond the lower handle.

7. The handheld rotary cutting blade of claim 1, wherein the lower handle is equipped with a slot made for an elastic bending inwards of two ends of the lower handle; the slot is arranged radially along the toroidal cutting blade.

8. The handheld rotary cutting blade of claim 1, wherein the handheld rotary cutting blade further includes a soft flexible plastic casing cover which covers one side of the lower handle; the side is away from the upper handle.

* * * * *